United States Patent [19]

Neal

[11] Patent Number: 4,649,605

[45] Date of Patent: Mar. 17, 1987

[54] METHOD FOR DETERMINING COHESION IN STAPLE FIBERS

[75] Inventor: Richard D. Neal, Kingsport, Tenn.

[73] Assignee: Eastman Kodak Company, Rochester, N.Y.

[21] Appl. No.: 853,241

[22] Filed: Apr. 17, 1986

Related U.S. Application Data

[63] Continuation-in-part of Ser. No. 727,324, Apr. 25, 1985.

[51] Int. Cl.[4] ..... D01G 15/46; G01N 3/00

[52] U.S. Cl. ..... 19/106 R; 19/296; 73/159; 73/840

[58] Field of Search ..... 19/106 R, 296; 73/838, 73/840, 37, 159

[56] References Cited

U.S. PATENT DOCUMENTS

| | | | |
|---|---|---|---|
| 2,557,184 | 6/1951 | Getchell | 73/840 |
| 3,251,218 | 5/1966 | Russell | 73/840 X |
| 3,600,940 | 8/1971 | Schlegel | 73/840 X |
| 4,198,853 | 4/1980 | Graham et al. | 73/159 X |
| 4,272,868 | 6/1981 | Grunder et al. | 19/106 R X |
| 4,503,704 | 3/1985 | Misenheimer | 73/159 |

FOREIGN PATENT DOCUMENTS

| | | | |
|---|---|---|---|
| 1120758 | 12/1961 | Fed. Rep. of Germany | 73/840 |

*Primary Examiner*—Louis K. Rimrodt
*Assistant Examiner*—J. L. Olds
*Attorney, Agent, or Firm*—Malcolm G. Dunn; William P. Heath, Jr.

[57] ABSTRACT

Method for determining whether textile staple fibers having crimp therein, either natural or man-made, have a weighted-average cohesion number of from 14.2 to 31.75 centimeters (5.6 to 12.5 inches) by initiating gas impingement contacts at successively increasing different pressure levels against a carded web of staple fibers to cause in the carded web the formation of visible bulges until the bulges are eventually ruptured 80 to 100% for a particular pressure level, and then recording the pressure and number of ruptures from each level and determining therefrom the weighted-average cohesion number.

8 Claims, 3 Drawing Figures

METHOD FOR DETERMINING COHESION IN STAPLE FIBERS

DESCRIPTION

This application is a continuation-in-part of application Ser. No. 727,324 filed Apr. 25, 1985.

TECHNICAL FIELD

The present invention relates to the process of carding staple fibers to form a web for subsequent conversion into a sliver ultimately leading to a form suitable for spinning into yarns, and is particularly directed to a method for determining whether textile staple fibers having crimp therein, either natural or man-made, have a weighted-average cohesion number of from 14.2 to 31.75 centimeters (5.6 to 12.5 inches) in a given lot of staple fibers by which it may be discovered whether or not a carded web and subsequently formed sliver from the carded web made from this lot of fibers will be sufficiently strong so as to avoid collapsing or breaking during normal processing operations in a textile mill.

When synthetic and/or natural staple fibers are converted into yarns, it is usually necessary to card the staple fibers so as to separate them, to form a fibrous web from them, and then to condense the resulting formed web into a silver. This sliver, which is a relatively parallelized, loose, essentially untwisted bundle, is continuously deposited into a container for use in subsequent processing, leading to a form that is suitable for spinning into yarns.

Staple fibers are of relatively short length, usually less than 15.24 cm (six inches) and in most cases, 5.08 cm (two inches) or less. It is important, therefore, that there be a certain minimum cohesiveness among the fibers so as to create sufficient strength in a carded web to prevent both the web and the subsequently formed sliver from collapsing or breaking during normal processing operations.

The structures of natural fibers, such as cotton and wool, are such that sufficient cohesiveness can be produced by proper selection of grade, staple length, fiber preparation and processing conditions.

For synthetic fibers such as polyester, acetate, acrylic, nylon, viscose rayon or polypropylene staple fibers, however, it has been found to be essential to create the required levels of cohesiveness by the use of special manufacturing processes. The primary process for creating cohesiveness is known as "crimping," by which the essentially straight fiber configuration is altered to produce a "wavy", sawtooth or helical configuration. Crimping is often performed by mechanical "stuffer-box" crimpers. However, the process of crimping can be achieved by a variety of means well known in the art and in literature. Crimping is generally performed before the fiber is cut into staple lengths.

The amount of cohesiveness possessed by a given batch of synthetic fiber is not dependent upon crimp by itself. Other factors of varying degrees of importance include polymer type, fiber cross-section, deposits (oligomers, etc.) on the fiber surface, the type and amount of processing lubricant, staple length, tex (or decitex) (denier) per filament, and the processing conditions used in the fiber manufacture and subsequent opening, feeding and carding conditions. The level of cohesion present in a given batch of staple fibers, therefore, is the result of numerous contributing factors of various degrees of importance.

In most synthetic fibers, with other factors under reasonable control, the character, degree of permanence, and control of variability in crimp are important determinants of successful carding performance and the subsequent production of sliver of satisfactory strength and uniformity. Those skilled in the art of crimping, however, have found that numerous problems can interfere with the attainment of consistently uniform crimp with adverse effects on the opening, feeding, and carding operations and the subsequent drafting, roving, and spinning operations.

Since uniformity of carding is a key factor in the production of sufficiently uniform sliver, roving, and ultimately yarn, it follows that the degree of and variability in cohesiveness of the fiber or fiber blend supplied to the carding apparatus are of major importance. Thus various attempts have been made to measure and/or control fiber cohesiveness.

BACKGROUND ART

Among these prior art instruments, apparatus, and processes are the following:

1. Instruments to measure sliver strength and/or "drag" during mechanical separation in the lengthwise direction. These are subject to large test errors, are time-consuming, and suffer from poor reproducibility and poor correlation with actual performance of the fiber in textile mills. In addition, it would be prohibitive timewise and costwise to test sufficient lengths of fiber to be representative of the entire lot of fiber.
2. Devices to measure picker-lap strength. A picker is a machine which prepares a rolled mat of fibers to be unrolled in a controlled manner to supply fibers to a card. This method of supplying fibers requires extra labor to prepare the laps and to transport them to the cards. Pickers are now being replaced by the more efficient, chute-feed systems which supply fiber directly to the carding machine. Devices to measure lap strength are of limited value because the test responses are suitable for identifying only extremely strong versus extremely weak laps and, in addition, these devices are dependent to a significant degree upon the uniformity of the lap. The predictive value and reproducibility of lap-strength tests, which undesirably alter the crimp significantly, are not satisfactory in the range of cohesiveness of greatest importance that falls between the extremes. In addition, the industry is moving away from expensive and slow picker-lap preparation and toward chute-feeding machines which accomplish some opening of the fiber while delivering it to a chute which transmits the fiber directly to the card input without the costly process of lap preparation.
3. Instruments and processes to measure the average of and/or variability in crimps per 2.54 centimeters (inch) and crimp angle of the staple fiber at some point prior to carding. These instruments and processes to measure crimps per 2.54 centimeters (inch) and angle are slow, time consuming, subject to large errors and have very poor predictive value concerning cohesiveness in the range of greatest importance between the extremes. Also, the relative contributions of a given combination of crimps per 2.54 centimeters (inch) and angle are difficult to measure. ASTM D-3937(13.2) states: "No justifiable statement can be made on the accuracy of Method D-3937 for testing crimp frequency since the true value cannot be established by an accepted referee method."

4. Visual assessment of the web during carding to attempt to classify the web as "clear," "cloudy," "streaky," etc. These visual assessments of the carded web produce such a wide variety of judgments with such poor reproducibility for a given set of samples that little or no practical benefit is gained as far as fiber cohesiveness is concerned.
5. Hand tests of the fiber removed from the bale to attempt to judge whether or not such handfuls fall apart easily, indicating low cohesion, or whether such samples of fiber exhibit greater resistance to falling apart when held elevated, indicating greater cohesiveness. Such hand tests are merely guesswork with very little practical benefit. Large differences in opinion are found among judges using hand tests.
6. Maximum carding rate, which is a judgment of the greatest sustainable production rate in kilograms (pounds) per hour for a given fiber sample on a given card, has been used in an attempt to measure fiber cohesiveness. This test, however, suffers from wide variability from one card to another and from one operator to another in judging the end point at which the carded web just begins to sag or curl. At best, this time-consuming test provides only a rough estimate of differences in cohesiveness among different lots of staple fiber. The judgment of the maximum sustainable carding rate suffers particularly from wide variation in the zones of major interest between the extremes of low-cohesion reject and high-cohesion reject. Since this test is based on operator judgment and results vary from card to card, it must be used with caution and with full understanding that it provides only a rough estimate of differences in cohesion. It is not accurate enough for quality control.
7. A colleague and I used air jet devices experimentally to blow with rising pressure at controlled rates into a carded web to create a bulge followed by attempts to determine by visual assessment at what air pressure the side walls of the bulge begin to create "open spaces" or "splits". This system suffered from poor reproducibility, however, due to wide variation among operators in guessing what constitutes an "open space" or "split." Poor results were obtained in tests with the jet mounted below the web and also in other tests in which the jet was mounted above the web. The location of the jet above the web was particularly poor in reproducibility and operation due to web collapses which made it necessary to clear the waste and rethread the card. These tests had poor correlation with actual carding perforance of the fiber in customers' mills and on our laboratory carding apparatus.

It was in the course of my own re-evaluation of this last experimental process or system described above that I discovered by accident an approach subsequently leading to the present invention. With the jet located below the web, I accidentally turned on too much air pressure, causing an unusually large bulge to form rapidly at this higher pressure followed quickly by an upward rupture of the top portion of the bulge. This ruptured portion of the bulge remained suspended in the stream of air in an upward position above the web and grew longer, up to 0.9 to 1.2 meters (three to four feet), as the carding machine continued to supply fiber in web form. The rupture resembled a long "tail" which was merely pulled harmlessly into the condensing guide along with the rest of the carded web and came out the other side of the condensing guide as part of the sliver. This proved to be a definite observable event for which an operator could readily say either that the bulge had ruptured into a tail or it had not so ruptured. I then began a systematic investigation and, after much trial and error, developed a dependable, reasonably precise operating method that correlates well with actual carding performance in customers' mills.

DISCLOSURE OF THE INVENTION

In accordance with the present invention, therefore, I provide a method for determining whether textile staple fibers having crimp therein, either natural or man-made, have a weighted-average cohesion number of from 14.2 to 31.75 centimeters (5.6 to 12.5 inches), which method comprises the following steps: A carded web of staple fibers is advanced from a carding machine and its doffer cylinder over a testing station having a gas jet positioned below the carded web. The carded web has a weight of from 0.0648 gram per 2.54 cm to 0.27 gram per 2.54 cm (one grain per inch to 4.2 grains per inch) of width of the doffer cylinder per 0.914 meter (yard) of length of the carded web. The gas jet is positioned 5.08 to 30.48 centimeters (2 to 12 inches) below the carded web and produces a gas impingement contact with the carded web extending at least 2.54 centimeters (1.0 inch) across the width of the carded web and at least 3.81 centimeters (1.5 inches) along the length of the carded web. Four to twenty gas impingement contacts at a pressure equivalent to a pressure of from 7.62 to 40.64 centimeters (3 to 16 inches) single-leg reading of a U-tube manometer using Meriam red oil having a specific gravity of 0.827 and wherein the airflow that activates the manometer is initially calibrated from 55.2 to 186.3 kilopascals (8 to 27 pounds per square inch gauge) are initiated at the testing station. Each gas impingement contact forms a visible upward bulge in the carded web of at least 1.27 centimeters (0.5 inch) above the normal path of the carded web and lasts for a length of time from 1 to 10 seconds. The pressure initially is selected to be below that will cause rupturing of the bulge. The gas impingement contacts are repeated for the above-mentioned number of times at succesively higher levels of pressures until during one of the levels 80 to 100% ruptures occur. The pressure and the number of ruptures at each pressure level are recorded. The number of ruptures at each pressure level is then multiplied times the pressure at each corresponding level. All the products obtained by the step of multiplying up to and including the pressure level at which at least 80% ruptures occurred are added to obtain the total number of failure points. The number of ruptures at each of the pressure levels is added to obtain total number of ruptures. Finally, the total number of failure points are divided by the total number of ruptures to determine the weighted-average cohesion number.

The length of time of the gas impingement contact is caused to last from 1.0 to 10 seconds, as heretofore mentioned, and preferably from 2.1 to 4.5 seconds.

The preferred number of gas impingement contacts initiated per level of pressure is ten.

The pressure employed may be indicated by a single-leg reading of a U-tube manometer wherein the pressure is from 7.62 to 40.64 centimeters (3 to 16 inches) of Meriam red oil having a specific gravity of 0.827 or at a pressure equivalent thereto.

Each gas impingement contact forms a visible bulge in the carded web that projects at least 2.54 centimeters (1 inch) above the normal path of the carded web.

A carded web may have a weight of 0.089 gram (1.38 grains) per 2.54 centimeters (1 inch) of width of the doffer cylinder per 0.914 meter (1.0 yard) of length of the carded web, and the gas jet may be positioned 6.6 centimeters (2.6 inches) below the carded web. In the above-described method, the step of initiating, therefore, may include initiating twenty gas impingement contacts at each of the pressure levels at a pressure equivalent to a pressure intially starting at 7.62 centimeters (3.0 inches) of Meriam red oil having a specific gravity of 0.827 against the carded web passing thereabove. The air flow that activates the manometer is initially calibrated at 118 kilopascals (17.1 psig). The length of time of each gas impingement contact is caused to last 1.8 seconds.

A carded web may also have a weight of 0.0648 gram (1 grain) per 2.54 centimeters (1 inch) of width of the doffer cylinder per 0.914 meter (1.0 yard) of length of the carded web, and the gas jet may be positioned 5.08 centimeters (2 inches) below the carded web. In the above-described method, the step of initiating, therefore, may include initiating four gas impingement contacts at each of the pressure levels at a pressure equivalent to a pressure initially starting at 5.1 centimeters (2 inches) of Meriam red oil having a specific gravity of 0.827 against the carded web passing thereabove. The air flow that activates the manometer is initially calibrated at 55.2 kilopascals (8 psig). The length of time of each gas impingement contact is caused to last 10 seconds.

A carded web may further have a weight of 0.089 gram (1.38 grains) per 2.54 centimeters (1 inch) of width of the doffer cylinder per 0.914 meter (1.0 yard) of length of the carded web. In the above-described method, the step of initiating, therefore, may include initiating ten gas impingement contacts at each of the pressure levels at a pressure equivalent to a pressure initially starting at 7.62 centimeters (3.0 inches) of Meriam red oil having a specific gravity of 0.827 against the carded web passing thereabove. The air flow that activates the manometer is initially calibrated at 186.3 kilopascals (27 psig). The length of time of each gas impingement contact is caused to last 10 seconds.

BRIEF DESCRIPTION OF DRAWINGS

The details of my invention will be described in connection with the accompanying drawings, in which.

BEST MODE FOR CARRYING OUT THE INVENTION

Figure 1:
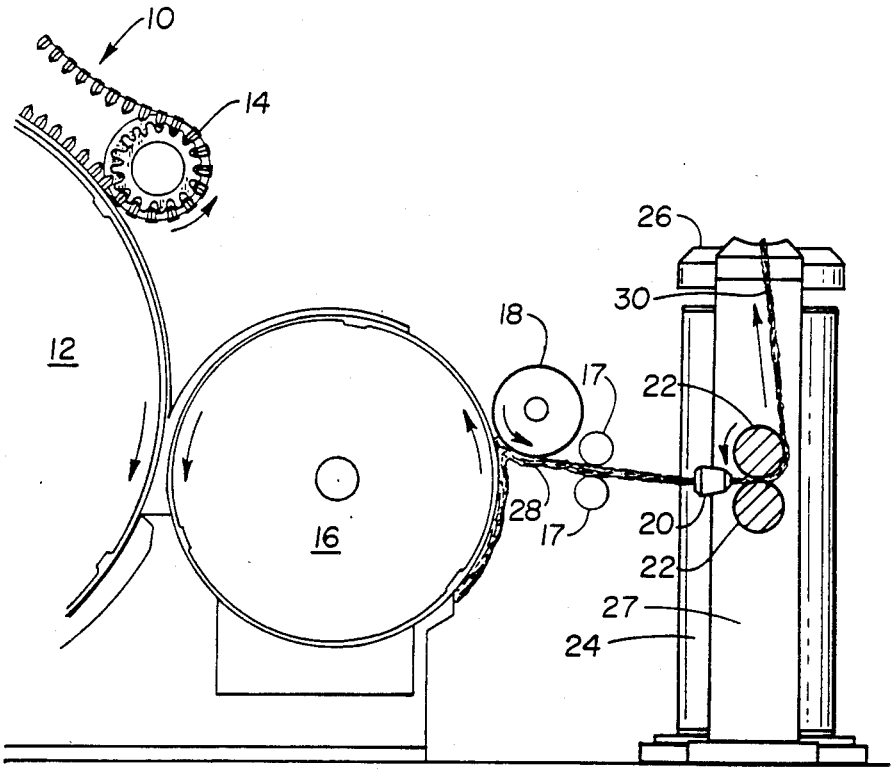
FIG. 1 is a schematic illustration showing in elevation a portion of a representative carding apparatus and a take-up apparatus partly in crosssection, a sliver coiler, and a sliver can.

In reference to FIG. 1, part of a representative carding apparatus 10 is shown, illustrating a carding cylinder 12 and flats 14, a doffer cylinder 16, delivery roll 17, and a doffer roll 18. Some carding apparatus have delivery rolls and some do not. Associated with the carding apparatus is a condensing guide 20, a pair of condenser rolls 22, a sliver can 24, and take-up apparatus and sliver coiler 26, including a coiler stand 27. Typically, a mat or web of fibers 28 is formed across the carding cylinder, which can be 45.7 to 114.3 centimeters (18 to 45 inches) or wider and the fiber is subjected to the opening action of thousands of fine wires which cover the flats 14 and carding cylinder 12. The doffer cylinder receives the opened fiber and carries it to the doffer roll 18 and the delivery rolls 17, which remove the web 28 of fibers, allowing the web to be pulled across the space between the delivery rolls 17 and condensing guide 20 by the condensing rolls 22. The web is narrowed and condensed into a sliver 30 by the condensing guide 20 and is further compressed by the condenser rolls 22. The take-up apparatus and sliver coiler 26 deposit the sliver 30 into the sliver can 24.

An example of a carding machine, for instance, is one made by John D. Hollingsworth-On-Wheels, Inc., and another is one made by Saco-Lowell Company, Inc., both having 101.6-centimeter (40-inch) width doffer cylinders. The staple fiber can be chute-fed (not shown) into the carding apparatus, such as by use of feeders may by Fiber Controls Company, Inc. and also made by Carolina Machinery Company, Inc. The carding apparatus and the feeders described thus far are well known in the art. As heretofore described, the process of carding serves to separate the staple fibers to form them into a fibrous web. The web is a relatively parallelized, loose, essentially untwisted bundle, which is condensed into a sliver for subsequent spinning into a yarn.

In reference to FIG. 2, in the space between the doffer cylinder 16 and the condensing guide 20 which I designate as the testing station 32, I have positioned a jet device 34 at a predetermined distance below the carded web as it moves across the space from the doffer cylinder and doffer roll (delivery rolls, if any) toward the condensing guide 20. This predetermined distance may vary between 5.08 centimeters (2 inches) and 30.48 centimeters (12 inches).

The jet device is suitably connected to a source of gas such as air and to actuating mechanism to be described so as to produce a gas impingement contact with the carded web. The gas impingement contact with the web extends at least 2.54 centimeters (1.0 inch across the width of the carded web and at least 3.81 centimeters (1.5 inches) along the length of the carded web and causes a visible bulge 36 to be formed in the carded web. The visible bulge projects at least 1.27 centimeters (0.5 inch) above the normal path of the carded web, and preferably at least 2.54 centimeters (1.0 inch). Each gas impingement contact lasts for a predetermined length of time, from 1.0 to 10 seconds, and preferably from 2.1 to 4.5 seconds.

The pressure is initially selected to be below what will cause rupturing of the visible bulge in the carded web. The gas impingement contacts are repeated from four to twenty times at successively higher levels of pressures until during one of the levels 80 to 100% ruptures occur. A rupture causes a separation of fibers from the web sufficient to cause an upwardly extending tail 38 to form. The tail is attached at the upstream portion of the carded web while the leading edge of the tail is the part which has initially separated and has been caused by the gas impingement contact to project upwardly. The resulting tail is observable as low as 2.54 centimeters (1 inch) above the bulge, depending upon operating circumstances.

In order to understand how the visible or readily observable bulge in the carded web and the rupture of such bulge fits into the scheme of my invention, it is necessary to know how the web jet device 34 may be connected to produce the gas impingement contact. The web jet device 34 is located preferably below the centerline of the web but can also be mounted below the web to one side or the other relative to the centerline.

The jet device 34, which was determined to be most effective, is a Sprayco ⅛ GG stainless jet having an 1.016 to 1.27 millimeters (0.040 to 0.050 inch) orifice. This particular jet device produced on contact with the carded web a conical pattern spreading to a well-defined approximately 10.16 centimeters (4-inches) circle at 10.16 centimeters (4 inches) from the jet device and continuing to spread as distance of the web from the jet device increases.

To determine the general shape of the air pattern, water was supplied to jets at 103.4 kilopascals (15 pounds per square inch) to provide a visible indication with the jet devices aimed downward toward a drain. In observing the effect of different jets on a web of fiber carded at 4.54 to 18.2 kilograms (10 to 40 pounds) per hour, it was judged that the jet device described above seemed to be the best in producing the most stable and uniform "bulge" at distances of 5.08 centimeters to 30.5 centimeters (2 inches to 12 inches) from the orifice of the jet device for detecting the failure point or rupture. The visible bulge will project at least 1.27 centimeters (0.5 inch) and preferably 2.54 centimeters (1.0 inch) above the normal path of the carded web as heretofore mentioned.

The jet device 34 is connected to a suitable gas conduit 40 which is connected to solenoid valve 42, followed by connection to a pipe tee 44 which in turn serves a diversion jet device 48. In order to avoid a sudden shock load or shock action by gas impingement, the portion of conduit 40 between the web jet device 34 and solenoid valve 42 should consist of at least two sections connected directly to each other. The section of conduit 40, which is connected to jet device 34, consists of at least a 1.22-meter (4-foot) length of at least 0.64 centimeter (0.25 inch) inside diameter tubing. This latter tubing is suitably connected to at least a 0.46-meter (1.5-foot) length of at least 1.9-centimeters (0.75 inch) inside diameter heavy duty tubing or air hose which is then suitably connected to solenoid valve 42. I found by trial and error that this construction of the portion of conduit 40 between jet device 34 and solenoid valve 42 allows the gas impingement contact to build the bulge in the web rapidly but smoothly without significant shock action. Such shock action can cause premature tail formations (ruptures) and thus is to be avoided. Between the diversion solenoid valve 46 and the diversion jet device 48 is a balancing valve 50 which serves to balance the manometer pressure in switching between the jet devices 34 and 48. I discovered that, in order for balancing valve 50 to function most effectively, the orifice in jet 48 should be at least 1.5 millimeters (0.06 inch) in diameter.

From the pipe tee 44, conduit 40 extends to orifice block 52, which serves to indicate the differential pressure across the orifice within the block, as indicated by a U-tube manometer 54. The orifice diameter of the orifice within the block may, for example, be 1.98 millimeters (0.078 inch). The inside diameter of conduit 40 may be at least 0.64 centimeter (0.25 inch).

From the orifice block 52, conduit 40 extends to a needle valve 56 and then to pressure regulator 58 (which regulates the airflow that activates the manometer), followed by a suitable union 60 and finally to gate valve 62. The gate valve is connected to the input supply line 64.

The solenoid valves 42 and 46 are activated in proper sequence by a push-button 66, which is operably connected to an electronic timer 68, such as ATC MOS time-delay relay (Automatic Timing and Controls Company, Inc., Type 328A200Q10XX) with an ATC relay base. Solenoid valve 42 and solenoid valve 46 are connected to the timer by electrical connections 65 and 67, respectively. A toggle switch 70 (Cutler-Hammer No. 8370K107) is provided to turn the electric current on and off. The timer is suitably connected to a power source by electrical connection 69.

Tubing, such as plastic tubing 72,74 of at least 0.64-centimeter (¼ inch) diameter is connected to each side of the orifice block 52 so as to include the orifice of the orifice block between the tubing connections and then to each leg of the U-tube manometer 54. The U-tube manometer is initially filled to the zero lines with Meriam red oil having a specific gravity of 0.827. For convenience in piping and connecting tubing, appropriate tees, reducers, elbows, unions, etc., are used to permit the cohesion test unit to conform to the location of the testing station 32 and the general outline of the carding apparatus. Frame 76 serves to support the timer and associated mechanism as well as the solenoid valves, etc. Web jet device 34 may be supported by frame 77.

Operation

The first action of the operator is to turn the toggle switch 70 to the "on" position. The solenoid valve 46 to the diversion jet device 48 is set to be normally opened and the solenoid valve 42 to the web jet device 34 is set to be normally closed to allow the operator to set the pressure level with the needle valve 56. The needle valve 56 is adjusted, for example, to produce a pressure equivalent to a single-leg manometer reading of 12.7 centimeters (5 inches) of Meriam red oil.

The circuit is designed so that when the operator depresses the push-button 66, the solenoid valve 46 to the diversion jet device 48 closes and approximately simultaneously the solenoid valve 42 to the web jet device 34 opens with the timer 68 permitting a flow of air to the web jet device. The time interval for this air flow is determined by testing, as will be described later, and can be changed merely by changing a time delay dial (not shown) on the timer, as required for calibrating different cohesion test units on different carding apparatus. The operator may push the push-button for each initiated gas impingement contact. During this time interval, the operator observes the web to determine whether or not a failure is indicated by a tail formation. After this interval, the actions of the solenoid valves are reversed automatically cutting off the air to the web jet device 34 and allowing the air to flow through the diversion jet device 48. The method of procedure and calculation for data thus obtained will be described later.

Weighted-Average Cohesion Number

After discovering that at a certain pressure level the bulge in the carded web that was formed by gas impingement contact would fail (rupture), thus forming a tail, it occurred to me that this inability of the carded web consistently to withstand pressure beyond a certain pressure level might possibly correlate in some meaningful manner with the overall carding performance of a batch or bale of staple fibers. In exploring this idea I found that there was for any given fiber sample a pressure level at which no failures (ruptures) would occur from the formed bulges. Then, at successively higher single-leg manometer pressure levels, an increasing number of failures or ruptures would occur until a pressure level was reached at which practically all initiated bulge formations would fail (rupture).

In this manner I arrived at a determination which I refer to herein as a weighted-average cohesion number. The latter is the result of the sum of failures (ruptures) at each preset pressure level multiplied by the manometer reading at that level to arrive at a total number of failure points up to and including the pressure level at which at least 8 to 10 failures (ruptures) occur in ten initiated bulges. The total number of failure points is then divided by the total failures (ruptures) to give a value that represents the weighted-average cohesion number.

For convenience, the test is started for example, at a pressure equivalent to a single-leg manometer reading of 12.7 centimeters (5 inches) (of Meriam red oil). If failures occur at this level (12.7 centimeters) during the ten initiated gas impingements, then a test is run at a pressure level of 10.2 centimeters (4 inches), etc., until there are no failures during one level of ten initiated gas impingement contacts, before proceeding to successively higher pressure levels of 15.2 centimeters (6 inches), 17.8 centimeters (7 inches), etc., until at least 80% failures (ruptures) occur at some final level for a particular sample being tested. As a practical matter, I have never observed any failures below 7.6 centimeters (3 inches) single-leg manometer reading. For convenience, the right leg of a U-tube Manometer is read.

The following example will illustrate how calculation is made for weighted-average cohesion number using blended textile staple fiber ("blended fiber" means that fibers were sampled from multiple positions within the bale) from a bale of 0.167 tex (1.67 decitex) per filament×38.1 millimeters (1.5 D/F×1.5 inch) staple-length staple such as polyester staple fiber of poly(ethylene terephthalate). Prior to this test, as a calibration starting point for this first cohesion test unit (hereinafter referred to as Unit 1), I set the weighted-average cohesion test unit herein described at 110.3 kilopascals (16 pounds per square inch) gauge input pressure, and 10.2 centimeters (4 inches) jet-to-web distance with a timer setting of 3.9 seconds for each of ten gas impingement contacts for each pressure level.

EXAMPLE 1

| Pre-set, Single-leg Manometer Pressure Level | Failures (Tail Formations) per 10 Gas Impingement Contacts | Total Points Per Pre-Set Manometer Level (Centimeter Times Failures) |
|---|---|---|
| 7.62 cm (3 in.) | 0 | 0 (0) |

-continued

| Pre-set, Single-leg Manometer Pressure Level | Failures (Tail Formations) per 10 Gas Impingement Contacts | Total Points Per Pre-Set Manometer Level (Centimeter Times Failures) |
|---|---|---|
| 10.2 cm (low) (4 in.) | 1 | 10.2 (4) |
| 12.7 cm (5 in.) | 5 | 63.5 (25) |
| 15.2 cm (6 in.) | 6 | 91.2 (36) |
| 17.8 cm (high)(7 in.) | 10 | 178.0 (70) |
| | total 22 | 342.9 (135) |

Fiber cohesion number $= \frac{342.9 \text{ centimeters}}{22}$ (135 in.) = 15.6 centimeters (6.1 in.) weighted-average

EXAMPLE 2

Figure 3:
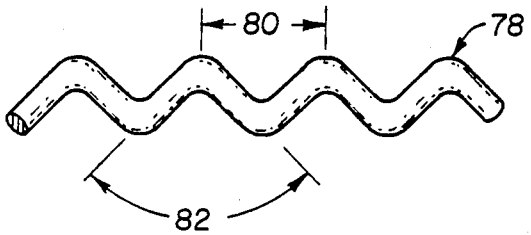
FIG. 3 illustrates a segment of an enlarged crimped staple fiber.

Test bales of fiber from a new lot produced weighted-average cohesion numbers of 14.2 to 15.0 centimeters (5.6 to 5.9 inches). The customer who received this shipment reported that the carding performance was borderline but acceptable. By a small margin this fiber had failed to meet the customer's standards for card web and silver breaks. In addition, the fiber would not perform consistently at this customer's target carding rate of 40.9 to 45.5 kilograms (90 to 100 pounds) per hour per card. Thus the customer's judgment that this fiber was no better than borderline acceptable was based on good evidence. Some other customers running similar fiber with cohesion numbers in this same range confirmed these findings. Subsequently this borderline-acceptable problem was corrected using the weighted-average cohesion test method to monitor the results of corrective action. When the crimp angle was made sharper (down to approximately 88° to 92°) and the crimp permanence was improved by increased crimper steam per kilogram (pound) of fiber, the cohesion numbers increased to the range of 18.8 to 22.1 centimeters (7.4 to 8.7 inches). With this higher level of cohesion, the customers were able to achieve their target carding production rates of 40.9 to 45.4 kilograms (90 to 100 pounds) per hour per card without difficulty. See FIG. 3 for an illustration of a segment of a staple fiber 78. The spacing 80 represents one crimp and the angle 82 represents the angle of the crimp.

EXAMPLE 3

During quality testing, a bale was found to have low cohesion, producing only a 10.9 centimeters (4.3-inches) weighted-average cohesion number using ten gas impingement contacts for each pressure level. On the laboratory carding machine I could not obtain sustained carding without web breaks at rates higher than 20.4 to 23.6 kilograms (45 to 52 pounds) per hour. Two more tests were run with this bale, obtaining excellent reproducibility of 10.9 centimeters and 11.4 centimeters (4.3-inches and 4.5-inches) weighted-average cohesion numbers. When the crimps per inch were raised sufficiently, the weighted-average cohesion number of subsequent bales of the same fiber production increased to the extent that a majority of individual bales had weighted-average cohesion values above 14.98 centimeters (5.9 inches) and none was lower than 14.2 centimeters (5.6 inches). The fiber was blended and subsequently carded by a customer at a carding rate of 132 kilograms (60 pounds) per hour.

EXAMPLE 4

Additional testing was done to determine the general weighted-average cohesion number ranges that represent low-cohesion reject, low-borderline acceptable, normal, high-borderline acceptable and high-cohesion reject levels. For this testing, 9 bales were used that had been rejected for low cohesion (for reasons such as carding web collapses and failure to card at the target rate); and 30 bales were used having borderline-acceptable and normal carding performances; and 8 bales were used that tended to tear and ball the fiber due to excessive cohesion. In summary, the following general standards for quality control were indicated for polyester (based upon polyethylene terephthalate polymer) using staple lots of 0.128 to 0.244 tex (1.15 to 2.2 denier) per filament, 3.05 to 5.08 centimeters (1.20 to 2.00 inches) staple fiber length, tested upon a John D. Hollingsworth carding machine with a 101.6-centimeter (40-inch) doffer cylinder which was equipped with cohesion testing equipment to determine the weighted-average cohesion number as disclosed herein and operated at 4.54±0.45 kilograms (10±1 pounds) per hour using a 3.56±0.194 gram (55±3 grains) sliver:

TABLE A

| Weighted-Average Fiber-Cohesion Ranges* cm (in.) | Fiber Cohesion Classification | Comments | Request Immediate Attention by Quality Control and Maintenance** |
|---|---|---|---|
| Less than 14.2 (5.6) | low | Remove from normal fiber | Yes |
| 14.2 to 15.2** (5.6 to 5.99) | Borderline-low** | Acceptable but safety factor needed | Yes |
| 15.21-26.4 (6.0 to 10.4) | Normal | The 15.21 to 26.4 range can be subdivided to meet requirements | No |
| 26.41-31.75** (10.4 to 12.5) | Borderline-high** | Acceptable but safety factor needed | Yes |
| 31.8 and above (12.51 and above) | high | Remove from normal fiber | Yes |

*Some textile mills operate carding machines at less than 34 kilograms (75 pounds) per hour while others operate above this production rate. In addition, the type, age, and condition of the processing equipment vary from one mill to another. Thus, one situation could use a range of cohesion values of 15.21 to 26.4 centimeters (6.0 to 10.4 inches) while another range of cohesion values could be more appropriate for a different situation. Thus additional standards can be developed, when appropriate, for specific customers or fiber types. A separate standard is needed for predicting the performance of fibers with a tex (denier) per filament lower than 0.128 (1.15) or higher than 0.24 (2.2) such as 0.33 to 3.33 tex (3-30 denier) per filament polyester fiber carded on a roller-top card and used for fiberfill, etc.

**Borderline zones can be used to furnish an extra margin of safety against producing fiber with low or high cohesion.

EXAMPLE 5

A trial program was then tried in which a 4.54 to 6.8 kilograms (10 to 15 pounds) bag of staple fiber was collected as a composite sample for each 10 bales of fiber for the sewing thread industry and produced over a period of several months. Each composite sample was then tested using the procedure of the invention including ten gas impingement contacts for each pressure level and at a pressure equivalent to a pressure initially starting at 7.62 centimeters (3.0 inches) single-leg reading of a U-tube monometer using Meriam red oil having a specific gravity of 0.827. Typical results taken from this test series are as follows:

TABLE B

| Creeling Number | Composite Sample Number | Weighted Average Cohesion Number cm (in.) | Fiber Cohesion Classification: Normal | Borderline | Low | Cause of Problem |
|---|---|---|---|---|---|---|
| 1 | 1-10 | 19.6 (7.7) | X | | | |
| 1 | 11-20 | 20.6 (8.1) | X | | | |
| 1 | 21-30 | 21.1 (8.3) | X | | | |
| 1 | 31-40 | 19.3 (7.6) | X | | | |
| 1 | 41-50 | 18.8 (7.4) | X | | | |
| 1 | 51-end | 17.0 (6.7) | X | | | |
| 2 | 1-10 | 18.5 (7.3) | X | | | |
| 2 | 11-20 | 18.8 (7.4) | X | | | |
| 2 | 21-30 | 14.7 (5.8) | | X | | * |
| 2 | 31-40 | 20.6 (8.1) | X | | | |
| 2 | 41-50 | 19.1 (7.5) | X | | | |
| 2 | 51-60 | 18.3 (7.2) | X | | | |
| 2 | 61-70 | 18.8 (7.4) | X | | | |
| 2 | 71-80 | 18.3 (7.2) | X | | | |
| 2 | 81-90 | 18.5 (7.3) | X | | | |
| 2 | 91-100 | 17.8 (7.0) | X | | | |
| 2 | 101-110 | 13.0 (5.1) | | | X | ** |
| 2 | 111-120 | 14.5 (5.7) | | X | | *** |
| 2 | 121-130 | 21.1 (8.3) | X | | | |
| 2 | 131-140 | 22.6 (8.9) | X | | | |
| 2 | 141-150 | 21.3 (8.4) | X | | | |
| 2 | 151-end | 18.3 (7.2) | X | | | |
| 3 | 1-10 | 20.3 (8.0) | X | | | |
| 3 | 11-20 | 21.3 (8.4) | X | | | |
| 3 | 21-30 | 19.8 (7.8) | X | | | |
| 3 | 31-40 | 21.6 (8.5) | X | | | |
| 3 | 41-50 | 20.8 (8.2) | X | | | |
| 3 | 51-60 | 23.6 (9.3) | X | | | |
| 3 | 61-70 | 21.6 (8.5) | X | | | |
| 3 | 71-80 | 21.1 (8.3) | X | | | |
| 3 | 81-90 | 18.5 (7.3) | X | | | |

*Waste in crimper
**Crimper malfunction
***Crimper adjustment

EXAMPLE 6

The following example illustrates a cohesion test in which the weighted-average cohesion number was calculated from four gas impingement contacts per pre-set, single-leg manometer pressure level. In this example, carding machine number 3 was set to produce a light web having a weight of 0.0648 gram (1 grain) per 2.54 centimeters (1 inch) of width of the doffer cylinder per 0.914 meter (1.0 yard) of length of the carded web. The doffer cylinder was 101.6 centimeters (40 inches) wide. Since a heavier web was produced on the carding machines used in the previous examples, the calibration procedure previously described was needed to adjust the settings as required. As a result of the calibration procedure, it was found that a jet-to-web distance of 5.08 centimeters (2 inches), an input air pressure of 55.2 kilopascals (8 psig) as measured on a pressure gauge on a pressure regulator and a time setting of 10 seconds produced the desired state of calibration using a sample of crimped, polyester staple fiber for which the weighted average cohesion number had been previously determined on another carding machine. Carding machine number 3 was adjusted to run at 3.3 kilograms (7.3 pounds) per hour. A nine kilogram (19.8 pounds) sample of crimped polyester fiber obtained at the start of a production run was tested. The fiber was 1.5 tex per filament (1.4 denier per filament) and 38 millimeters (1.49 inches) in staple length. This test was initially started at a pressure equivalent to a pressure of 5.1 centimeters (2 inches) single-leg reading of a U-tube manometer because there was no prior history available for this particular fiber.

The following weight-average cohesion number was obtained:

| Pre-set, Single-leg Manometer Pressure Level* | Failures (Tail Formations) per 4 Gas Impingement Contacts | Total Points Per Pre-Set Manometer Level (Centimeter Times Failures) | |
|---|---|---|---|
| 5.1 cm (2 inches) | 0 | 0.0 (0) | failure points |
| 7.6 cm (3 inches) | 2 | 15.2 (6) | failure points |
| 10.2 cm (4 inches) | 4 | 40.8 (16) | failure points |
| 12.7 cm (5 inches) | ** | ** | |
| | total 6 | 56.0 (22) | |

Fiber cohesion number or weighted-average cohesion number =

$$\frac{56.0}{6} \quad \frac{(22)}{(6)} = 9.3 \text{ centimeters (3.7 inches)}$$

Figure 2:
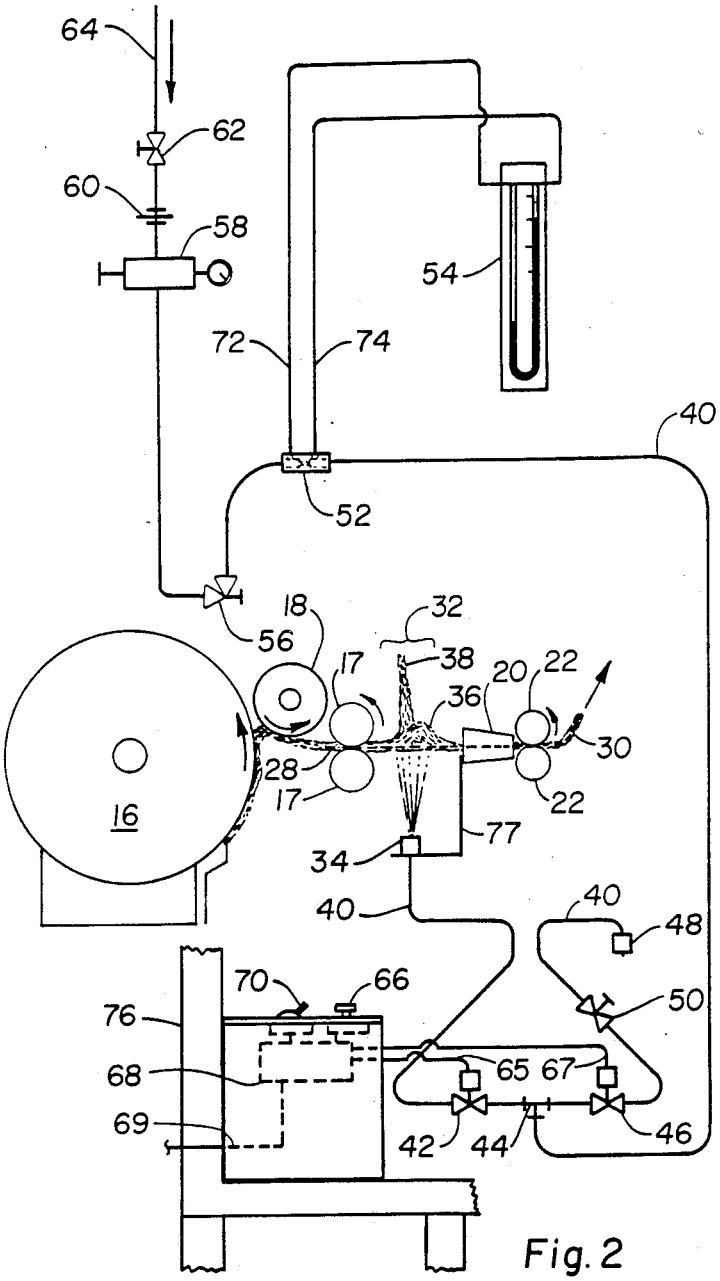
FIG. 2 is a schematic of the apparatus for initiating gas impingement contact against a carded web and one form of a pressure determining device such as a U-tube manometer and the associated connected gas conduits and control devices.

*This is the pressure which represents the differential pressure measured across an orifice 52 shown in FIG. 2.

**No exposures needed at 12.7 cm since this sample had at least 80% failures at 10.2 cm in this test.

EXAMPLE 7

Another carding machine was equipped with cohesion test equipment and calibration was conducted as previously described. The jet-to-web distance was measured to be 6.6 centimeters (2.6 inches), the required input pressure measured on the gauge on the pressure regulator was 118 kilopascals (17.1 pounds per square inch gauge), and the timer was set on 1.8 seconds. This carding machine was set to produce a sliver weight of approximately 0.089 gram (1.38 grains) per 2.54 centimeters (1 inch) of width of the doffer cylinder per 0.914 meter (1.0 yard). For convenience, the sliver weight (3.56 grams) (55 grains) was determined by weighing and averaging three 0.914 meter (1.0 yard) lengths of sliver. A 40 kilogram (88 pounds) sample of crimped, polyester staple fiber was obtained from a production line which was started after being given routine mechanical services. In a cohesion test using twenty gas impingement contacts of the web to the jet of air per pre-set single-leg manometer level and starting initially at a pressure level of 7.62 centimeters (3.0 inches), a weighted-average cohesion number of 13.5 centimeters (5.3 inches) was obtained. Since the specification for this fiber lot called for a minimum weighted-average cohesion number of at least 15.5 centimeters (6.0 inches), the crimps per 2.54 centimeters (crimps per inch) were increased and the crimper steam pressure was increased sufficiently to increase the weighted-average cohesion number to 17.3 centimeters (6.8 inches). In two additional tests, values of 16.4 centimeters (6.8 inches) were obtained. In this particular case, the customer's carding machines were set to operate at comparatively slow production rate of 13.6 kilograms (30 pounds) per hour to make sliver to be further processed to make a high-quality sewing thread.

EXAMPLE 8

A carding machine was equipped with cohesion test equipment and calibration was conducted as previously described. The jet-to-web distance was determined to be 8.9 centimeters (3.5 inches). The required input pressure measured on the gauge on the pressure regulator was 186.3 kilopascals (27 pounds per square inch gauge [psig]) and the timer was set on 1 second. This carding machine was operated at a carding rate of 6.8 kilograms (15 pounds) per hour and set to produce a web weight of approximately 0.089 gram (1.38 grains) per 2.54 centimeters (1 inch) of width of the doffer cylinder per 0.914 meter (1.0 yard) of length of the carded web. A blended 20 kilogram (44 pounds) sample of crimped, polyester, staple fiber was obtained from a production line which was started after being given routine mechanical services. In a cohesion test using ten gas impingement contacts of the web to the jet of air per initially pre-set single-leg, manometer level of 7.62 centimeters (3.0 inches), a weighted-average cohesion number of 16.3 centimeters (6.4 inches) was obtained using the procedure previously described.

EXAMPLE 9

In a series of tests, I found, using blended crimped polyester fiber having a weighted-average cohesion number of 16.2 centimeters (6.4 inches), that I was able to calibrate a cohesion test unit up to a web weight of 0.27 grams per 2.54 centimeters (4.2 grains per inch) of width of the carded web per 0.914 meter (1.0 yard) of length of carded web.

EXAMPLE 10

A carding machine was equipped with cohesion-test equipment and calibration was conducted as previously described. The jet-to-web distance was measured to be 8.9 centimeters (3.5 inches), the required input pressure measured on the gauge on the pressure regulator was 113.0 kilopascals (16.4 psig), and the timer was set on 3.8 seconds. This carding machine was operated at 13.6 kilograms per hour (30 pounds per hour) and was set to produce a sliver weight of 4.2 grams per 0.914 meter (65 grains per yard). Four different samples of a highly-crimped polyester staple fiber of 0.13 tex per filament and 3.81 centimeters staple length (1.2 denier per filament and 1.5 inches staple length) were used. The doffer cylinder was 101.6 centimeters (40 inches) wide. In cohesion-tests wherein ten gas impingement contacts were made for each pressure level starting initially at a pressure level of 2.54 centimeters (1.0 inch) for each sample, weighted-average cohesion values of 31.2 cm (12.3 in.). 33.3 cm (13.1 in.), 32.3 cm (12.7 in.) and 31.8 cm (12.5 in.) were obtained. These tests were started at 2.54 centimeters (1.0 inch) single-leg reading of U-tube manometer because measurements were being made to determine visible bulge heights at the different pressure levels.

It was found with this continued investigation that this novel method for obtaining and calculating the weighted-average cohesion number provided a fast and accurate prediction of the carding performance of the staple fiber in the customer's mills, and that immediate corrective action can be taken to prevent shipment of defective fiber. This is to be compared with the prior art methods where it is possible to have extended runs of staple fiber that are of low or high cohesion and which are not detected.

Some of the causes that require quick detection and correction include crimper malfunctions, percent fiber lubricant being below or above critical limits, broken or leaking steam lines, malfunctions during orientation (drawing) of the fiber or in drying, etc.

In the course of these experiments it was discovered that no two carding machines are exactly alike in forming a web. Thus when using the same lot of blended fibers for calibration, it was found that different settings of the input pressure regulator, the timer and the jet-to-web distance for the cohesion test are required for the different carding machines. Also it was found to be important to use different sliver weights and production rates on carding machines that serve different functions, such as quality control and technical service. It was subsequently determined from these experiments that these different carding machines could be calibrated in such manner as to produce approximately the same weighted-average cohesion number when testing the same lot of blended staple fiber.

The following descriptions, therefore, clearly illustrate how the testing stations on the different carding machines used for different purposes, requiring different sliver weights and production rates, can be calibrated to produce approximately the same weighted-average cohesion number using blended staple fiber from the same bale.

A. Calibrating Cohesion Test Units on Two Carding Machines

After obtaining favorable results with Unit 1, I constructed Unit 2 in the same manner in order to use a second card to test 10-bale composites of fiber from a wider variety of lot numbers. After I determined that the fiber in Example 1 produced a weighted-average cohesion number of 15.5 centimeters (6.1 inches), I realized that I could use additional blended fiber from this same bale to calibrate cohesion test Unit 2. However, I soon discovered that a novel calibration technique was required. I initially set Unit 2 on the same settings for the input-pressure regulator 58, timer 68, and jet-to-web distance. However, instead of obtaining the desired value of 15.5 (6.1), Unit 2 initially produced a low weighted-average cohesion number of 14.48 centimeters (5.7 inches). After much trial and error, I discovered that the following calibration method would produce the desired results:

1. The manometer was set on 15.24 centimeters (6 inches) single-leg reading (2.54 centimeters [one inch] less than the calibration test maximum of 17.78 centimeters [7 inches]).
2. Observing that the failures at 15.24 centimeters (6 inches) single-leg manometer reading were generally occurring early in the 3.9-second time interval, I realized that the input pressure was too high. Therefore I reduced the input pressure until I obtained less than 8 ruptures but more than 5 at said 15.24 centimeters (6 inches) manometer reading in order to bracket the results obtained at 15.24 centimeters (6 inches) in Example 1. The reduced pressure I thus obtained was 104.1 kilopascals gauge (15.1 psig).
3. Next I tested the fiber at 17.78 centimeters (7 inches) manometer reading and obtained 10 ruptures at the new input pressure of 104.1 kilopascals gauge (15.1 psig).
4. If I had not obtained 10 ruptures at 17.78 centimeters (7 inches), it would have been necessary to increase the pressure above 104.1 kilopascals (15.1 psig) and reduce the time of exposure well below the 3.9 seconds used in Example 1. If the action in Step 4 then caused too many failures in repeat testing at 15.24 centimeters (6 inches), it would be necessary to increase the jet-to-web distance by 2.54 centimeters (one inch) initially and begin again at Step 1.
5. In view of the successful results in Step 3, I then ran ten gas impingement contacts at 15.24 centimeters (6 inches) and ten at 17.78 centimeters (7 inches) single-leg manometer reading. I observed that the breaks at 15.24 cm (6 inches) manometer pressure were generally occurring at 2 seconds time and those at 17.78 centimeters (7 inches) were generally occurring in less than 2 seconds. Therefore to greatly reduce the probability of random occurrences of excessive numbers of breaks at 15.24 cm (6 inches), I reduced the timer from the initial setting of 3.9 seconds to a setting of 2.6 seconds.
6. Complete tests were then conducted with the card set on 4.54±0.45 kilograms (10± pounds) per hour and the sliver weight at 3.56±0.194 grams per 0.914 meters (55±3 grains per yard) using the new settings of 104.1 kilopascals gauge (15.1 psig) input pressure and 2.6 seconds on the timer with the jet-to-web distance remaining at 10.2 cm (4 inches). In three tests I obtained weighted-average cohesion test numbers, starting initially at 7.62 centimeters (3.0 inches) single-leg reading U-tube manometer, of 16.0, 15.2, and 15.5 centimeters (6.3, 6.0 and 6.1 inches).

Since these values agree clearly with the 15.5 centimeters (6.1 inches) obtained in Example 1, I concluded that this calibration procedure had produced the desired calibration of Unit 2.

If these tests had not agreed closely with 15.5 centimeters (6.1 inches) obtained for the calibration bale, it would then have been necessary to start over at Step 1 using the new settings listed in this Step 6 as the starting point to obtain the desired calibration. Thus it will be apparent that calibration is necessary for each carding apparatus using the cohesion test unit.

Once satisfactorily calibrated, the cohesion test unit tends to hold this calibration for an extended period of time unless damage occurs to the carding apparatus for some reason. Of course, any modifications of the cohesion test unit may require recalibration. Thus recalibration more frequently than 6 to 8 weeks or more is seldom needed.

B. Calibrating Cohesion Test Units to Test Two or More Weights of Sliver on Two or More Carding Machines In simulating the conditions used at two or more customers' plants in order to provide the most beneficial quality control and/or technical service, it is sometimes necessary to use different sliver weights in carding. For example, one customer could use 3.56 grams (55 grains) sliver in his carding operation and another customer could use 4.21 grams (65 grains) sliver. Since, as previously described, calibration of cohesion test Units 1 and 2 was done using 3.56 grams (55 grains) sliver, it would be necessary to recalibrate for the heavier sliver. The same principles for calibration would be followed as previously outlined and, of course, the final result would reflect the fact that greater input air pressure set at the pressure regulator 58 and/or a longer time interval set on timer 68 would be required to obtain the required ruptures in the heavier sliver. The jet-to-web distance could be increased or decreased as previously described, but only if necessary to facilitate the attainment of the weighted-average cohesion number required for calibration. The same principles would hold true in recalibration required to change from the original 4.54 kilograms (10 pounds) per hour carding rate to some higher carding rate such as 6.8 or 18.2 kilograms (15 or 40 pounds) per hour, etc.

In another, more expensive, automated test a photocell system was included to detect the failure point of the visible bulge at least 15.2 centimeters (6 inches) above the web and provide an automatic flash of a red light to show the operator that the failure point had been received and/or to record automatically failures versus total exposure. Other detectors could be used instead of a photocell and more than one detector could be used, if necessary. As a convenience to terminate quickly a tail formation, a solenoid valve can be used to cut off temporarily the air supply. Of course, an even more expensive system would feed the number of activations of the push-button switch, the number of failures, the pressure levels, and the time intervals from activation to failure into a computer for automatic calculations and data output. In another option, an electronic manometer or a pressure transducer and the necessary signal receiver and recorder can be used instead of the U-tube manometer.

The invention has been described in detail with particular reference to preferred embodiments thereof, but it will be understood that variations and modifications can be effected within the spirit and scope of the invention.

I claim:

1. Method for determining whether textile staple fibers having crimp therein, either natural or man-made, have a weighted-average cohesion number of from 14.2 to 31.75 centimeters (5.6 to 12.5 inches), said method comprising the steps of:

advancing a carded web of staple fibers from a carding machine and its doffer cylinder and over a testing station having a gas jet positioned below the carded web, said carded web having a weight of from 0.0648 gram per 2.54 centimeters to 0.27 gram per 2.54 centimeters (one grain per inch to 4.2 grains per inch) of width of said doffer cylinder per 0.914 meter (1.0 yard) of length of the carded web and said gas jet being positioned 5.08 to 30.48 centimeters (2 to 12 inches) below the carded web and producing a gas impingement contact with the carded web extending at least 2.54 centimeters (1.0 inch) across the width of the carded web and at least 3.81 centimeters (1.5 inches) along the length of the carded web;

initiating at the testing station four to twenty gas impingement contacts at a pressure equivalent to a pressure of from 7.62 to 40.64 centimeters (3 to 16 inches) single-leg reading of a U-tube manometer using Meriam red oil having a specific gravity of 0.827 against the carded web passing thereabove and wherein the airflow that activates the manometer is initially calibrated from 55.2 to 186.3 kilopascals (8 to 27 psig), each gas impingement contact forming a visible bulge in the carded web of at least 1.27 centimeters (0.5 inch)

above the normal path of the carded web and lasting for a length of time of from 1 to 10 seconds, said pressure initially being below what will cause rupturing of the bulge;

repeating said gas impingement contacts as successively higher levels of pressure until during one of said levels 80 to 100% ruptures occur; and recording the pressures and the number of ruptures at each pressure level; multiplying the number of ruptures at each pressure level by the pressure at each corresponding level; adding all products obtained by the step of said multiplying up to and including the pressure level at which at least 80% ruptures occurred to obtain the total number of failure points; adding the number of ruptures at each of said pressure levels to obtain total number of ruptures; and dividing the total number of failure points by the total number of ruptures to determine the weighted-average cohesion number.

2. Method as defined in claim 1 wherein said length of time of said gas impingement contact is caused to last from 1.8 to 10 seconds.

3. Method as defined in claim 1 wherein said length of time of gas impingement contact is caused to last from 2.1 to 4.5 seconds.

4. Method as defined in claim 1 wherein each gas impingement contact forms a visible bulge in the carded web that projects at least 2.54 centimeters (1 inch) above the normal path of the carded web.

5. Method as defined in claim 1 wherein said carded web that is advanced has a weight of 0.089 gram (1.38 grains) per 2.54 centimeters (1 inch) of width of the doffer cylinder per 0.914 meter (1.0 yard) of length of the carded web, said gas jet is positioned 6.6 centimeters (2.6 inches) below the carded web, and said step of initiating includes initiating twenty gas impingement contacts at each of said levels at a pressure equivalent to a pressure initially starting at 7.62 centimeters (3.0 inches) of Meriam red oil having a specific gravity of 0.827 against the carded web passing thereabove, the air flow that activates the manometer initially being calibrated at 118 kilopascals (17.1 psig), and said length of time of each said gas impingement contact being caused to last 1.8 seconds.

6. Method as defined in claim 1 wherein said number of gas impingement contacts initiated per level of pressure is ten.

7. Method as defined in claim 1 wherein said carded web that is advanced has a weight of 0.0648 gram (1 grain) per 2.54 centimeters (1 inch) of width of the doffer cylinder per 0.914 meter (1.0 yard) of length of the carded web, said gas jet is positioned 5.08 centimeters (2 inches) below the carded web, and said step of initiating includes initiating four gas impingement contacts at each of said levels at a pressure equivalent to a pressure initially starting at 5.1 centimeters (2 inches) of Meriam red oil having a specific gravity of 0.827 against the carded web passing thereabove, the air flow that activates the manometer initially being calibrated at 55.2 kilopascals (8 psig), and the length of time of each said gas impingement contact being caused to last 10 seconds.

8. Method as defined in claim 1 wherein said carded web that is advanced has a weight of 0.089 gram (1.38 grains) per 2.54 centimeters (1 inch) of width of the doffer cylinder per 0.914 meter (1.0 yard) of length of the carded web, said gas jet is positioned 8.9 centimeters (3.5 inches) below the carded web, and said step of initiating includes initiating ten gas impingement contacts at each of said levels at a pressure equivalent to a pressure initially starting at 7.62 centimeters (3.0 inches) of Meriam red oil having a specific gravity of 0.827 against the carded web passing thereabove, the air flow that activates the manometer initially being calibrated at 186.3 kilopascals (27 psig), and the length of time of each gas impingement contact being caused to last 10 seconds.

* * * * *